United States Patent [19]

Schley

[11] 4,194,619

[45] Mar. 25, 1980

[54] MULTIPLE FLUID STORAGE CONTAINER

[76] Inventor: Kenneth E. Schley, 2481 Northland St., Cuyahoga Falls, Ohio 44221

[21] Appl. No.: 947,485

[22] Filed: Oct. 2, 1978

[51] Int. Cl.[2] ..... B65D 77/04; B65D 85/62

[52] U.S. Cl. ..... 206/217; 206/546; 206/431; 215/10; 220/23.4

[58] Field of Search ..... 206/431, 546, 541, 217; 220/20, 23.4; 215/6, 10; 150/34

[56] References Cited

U.S. PATENT DOCUMENTS

| | | | |
|---|---|---|---|
| 146,783 | 1/1874 | Richardson | 215/10 |
| 318,909 | 5/1885 | Jones | 215/10 |
| 2,533,850 | 12/1950 | Syracuse | 150/34 |
| 2,746,634 | 5/1956 | Smith | 215/6 |
| 3,187,757 | 6/1965 | Jones, Jr. et al. | 220/23.4 |
| 3,469,739 | 9/1969 | Phillips | 206/217 |

*Primary Examiner*—William T. Dixson, Jr.
*Attorney, Agent, or Firm*—Oldham, Oldham, Hudak & Weber Co.

[57] ABSTRACT

A flexible storage container housing several rigid decanters for storage of a variety of fluids is provided. The decanters are designed to form a cylinder when placed together, and each decanter has a recessed area, which when joined provides a storage area for jiggers which are stacked in place. A protective cover for the jiggers and a protective top on the flexible container prevent contamination during transport.

7 Claims, 2 Drawing Figures

MULTIPLE FLUID STORAGE CONTAINER

BACKGROUND OF INVENTION

Heretofore, many different devices throughout history have been employed to transport fluids from one place to another. More specifically, an individual has always had containers for carrying these fluids during travel, to employment, to recreational activities and other events where the availability of the fluids at the final location were limited or not existent. The use of these containers has facilitated comfort and enjoyment for the individual.

Some containers have been made from the materials readily available, such as sacs and pouches developed from parts of animals. Other containers have utilized man-made materials, fashioned from raw materials available or in commerce.

The shape and characteristics of each container reflected its intended use. For example, materials were developed to maintain the temperature of the fluid within the container. Moreover, materials were used of light mass in order to shape a container of minimal weight for easy transport.

The type of fluid stored in the container determines the configuration of the opening to the container. For example, solid matter within a liquid necessitated a large orifice, while a pure liquid required only a minimal orifice.

Any one type of container could be adapted for use in an area other than its intended use, but its functional capability was limited by that intended use. For example, a flask designed for the transport of alcohol to social activities was limited in its application as a container for transport of liquids to employment locations.

Therefore, it has become well known to the art that specialized containers are needed for each conceivable human activity, no one container being completely adaptable from one intended use to another. Moreover, the container in its design and utility must appeal to consumer tastes.

OBJECTS OF INVENTION

Consequently, it is an object of the invention to provide a multiple fluid storage container wherein each fluid is separately stored in an individualized compartment.

It is also an object of the invention to provide a multiple fluid storage container wherein the entire container is made of lightweight materials to facilitate ease of transport.

It is yet another object of the invention to provide a multiple fluid storage container wherein each fluid compartment is removable from the container proper.

Yet another object of the invention is to provide a multiple fluid storage container wherein the entire container is made from unbreakable and shatterproof material to prevent loss of the fluids or potential injury if dropped during transport.

Moreover, it is yet another object of the invention to provide a multiple fluid storage container wherein mixing vessels are included for the mixing of the various fluids contained in the individualized compartments.

Yet another object of the invention is to provide a multiple fluid storage container wherein each compartment has beveled surfaces to achieve maximum compactness and recessed areas on the interior of each individualized compartment to provide a storage area for the mixing vessels.

Yet another object of the invention is to provide a multiple fluid storage container that has great utility for sporting and recreational activities not requiring sturdy containment nor maintenance of temperature.

Still another object of the invention is to provide a multiple fluid storage container wherein the outer storage container protects the fluid compartments and mixing vessels from foreign matter.

Still another object of the invention is to provide a multiple fluid storage container wherein the structure, design and utility of the storage container is maximized for recreational use.

The foregoing and other objects of the invention are achieved by a storage apparatus comprising a flexible container housing a multiplicity of rigid storage decanters and rigid measuring jiggers, said flexible container having cylindrical shape, carrying means for transporting said decanters and said jiggers, and enveloping means for protecting and enclosing said decanters and said jiggers; each said decanter having an arcuate outer perimeter, the combination of said perimeters of said decanters forming a rigid cylinder having a length and a circumference, said cylinder supporting said cylindrical shape of said flexible container; each said decanter having beveled interior surfaces extending inwardly from said arcuate outer perimeter, said interior surfaces joining at an angle defined by equal division of said cylindrical circumference by the multiplicity of said decanters; each said decanter having an arcuate interior surface recessed from said beveled interior surfaces for a fraction of said cylindrical length, and a plateau surface where said arcuate interior surface joins said beveled interior surfaces; each said decanter having an upper surface wherein resides opening means for dispensing liquid stored in said decanter; said jiggers having means for separable stacking and a protective cover, and said jiggers residing in said area formed by said arcuate interior surfaces and said plateau surfaces of said decanters when combined to form said rigid cylinder for said flexible container.

DESCRIPTION OF THE PREFERRED EMBODIMENT

Figure 1:
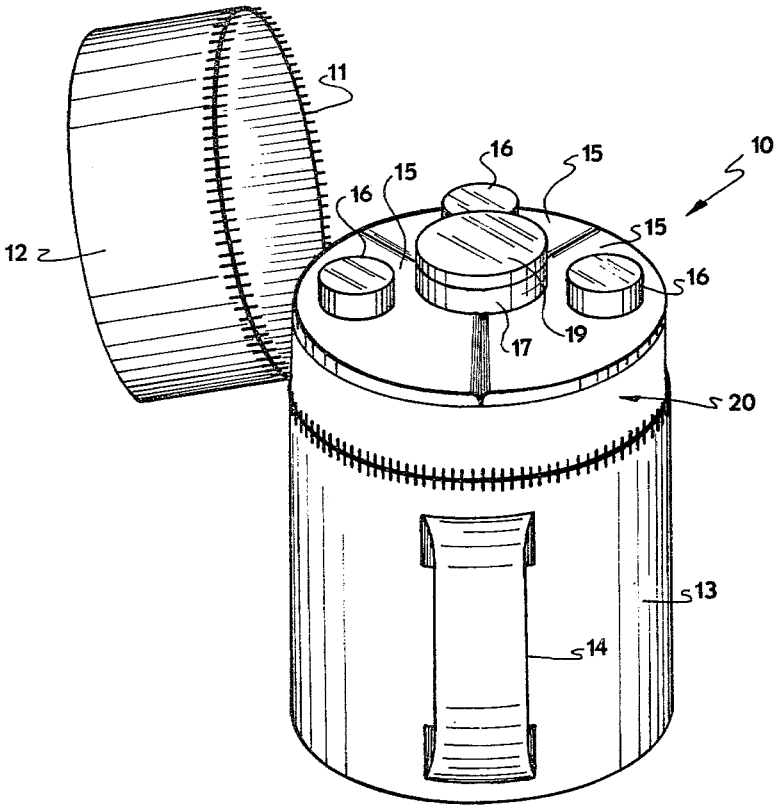
Figure 2:
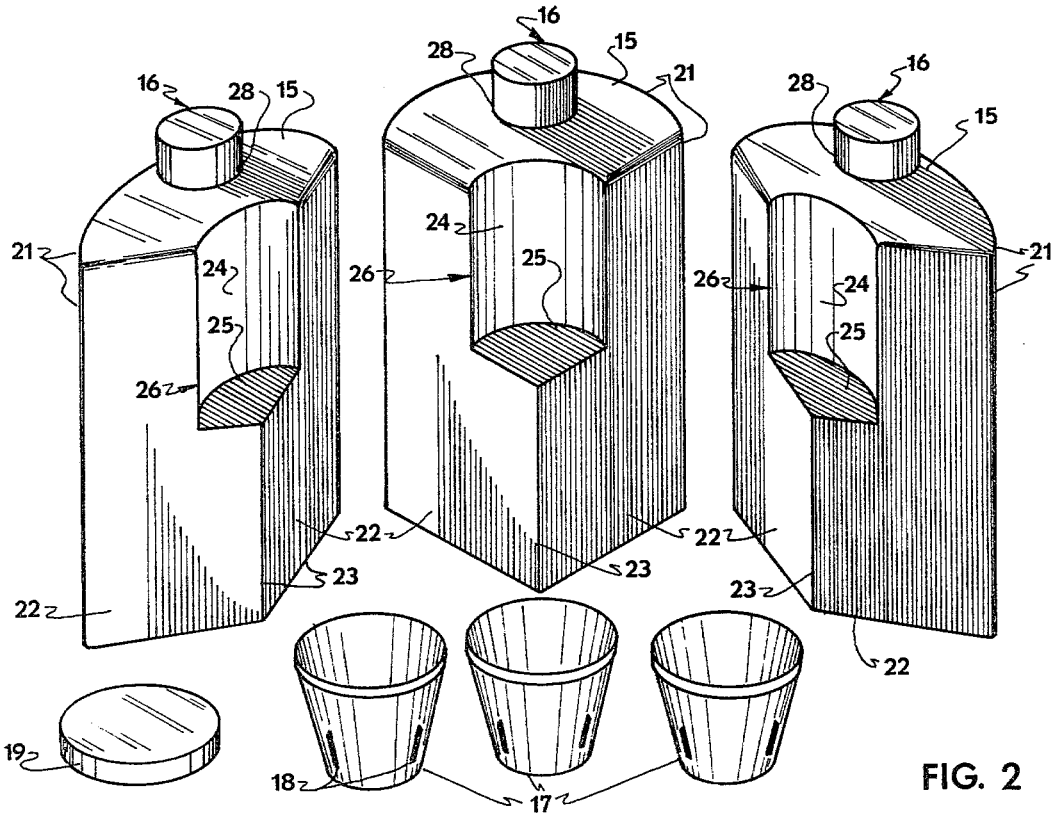

For a more complete understanding of the structure of the multiple fluid storage container, reference is had to the following description accompanied by reference to the drawings:

FIG. 1 is a side plan view of the multiple fluid storage container as assembled and ready for transport; and FIG. 2 is a side plan view of the interior components of the multiple fluid storage container as separated for use.

Referring now to FIG. 1, the structure of the invention may be seen and readily understood. The flexible storage container, generally referred to as 10, is composed of a flexible pouch 13, three rigid storage decanters 15, three rigid measuring jiggers 17, and a protective cover 19. The flexible pouch 13 has a zippered top 12 and a zipper 11 which encloses the storage decanters 15 and measuring jiggers 17 from exposure to foreign matter. The flexible pouch 13 may be made from materials well known to those skilled in the art, such as cloth or a plastic.

Attached to the flexible pouch 13 is a handle 14 attached to the flexible pouch 13 by conventional means. This handle 14 facilitates ease of transport.

When the storage decanters 15 and measuring jiggers 17 are not inside the flexible pouch 13, there is no structure supporting the outer circumference of the flexible pouch 13. However, as will be more fully discussed later, the rigid storage decanters 15, when joined together for storage, provide a cylindrical structure for the storage container 10.

Referring now to FIG. 2, a greater understanding of the design and structure of the decanters 15 and jiggers 17 may be achieved. Each decanter 15 has a shape designed to accommodate the number of decanters 15 within the cylinder to be formed, herein referred to generally as 20. More specifically, in the preferred embodiment, the decanter 15 is designed to be joined with two others of like shape to form the cylinder 20. As such, the decanter 15 has arcuate outer perimeters 21 extending the length of the decanter 15, beveled interior surfaces 22, a junction angle 23, an arcuate interior surface 24, and a plateau surface 25.

The beveled interior surfaces extend from the edge of the arcuate outer perimeter to the junction angle 23. The junction angle 23 is defined by circumference of 360° divided by the number of decanters 15 to be used within the storage container 10. In this instance, as shown by FIG. 2, the junction angle is 120° to accommodate three decanters 15 in the storage container 10.

FIG. 2 also demonstrates the accommodation by each decanter 15 to provide a recessed area generally referred to as 26 for the storage of the measuring jiggers 17. For this purpose, the decanters 15 are arcuate interior surfaces 24 extending from the uppermost point of the decanter 15 to a point a fraction of the length of the decanter 15. At that point, parallel to the upper and lower surfaces of the decanter 15 resides a plateau surface 25 against which the lower surface of the measuring jiggers 17 may rest. When the decanters are joined together for storage, the combination of each recess area 26 forms a convenient interior cylinder area for storage of the measuring jiggers 17. This installation may be seen by referring to FIG. 1.

Each decanter 15 has an opening apparatus generally referred to by the number 16. While a variety of structure for the opening apparatus exist and can be utilized in this invention, a screw cap apparatus 28 is shown. The diameter of the opening apparatus 16 is a function of the type of fluid to be stored within the storage decanters 15. The size of the opening apparatus however is limited to the distance between the arcuate outer perimeter 21 and the arcuate interior surface 24.

The jiggers 17 may be stored within the recessed area 26 by stacking one jigger upon the other. To prevent the jiggers from becoming immovable in this configuration, stacking means 18 are employed. These stacking means may utilize a variety of structures well known to those skilled in the art, but for this embodiment, a series of extensions on the interior circumference of each jigger 17 prevents complete compression of the length of one jigger 17 into another jigger 17. To protect the jiggers 17 during storage from foreign matter and debris, a protective cover 19 may be utilized by placement of the protective cover 19 over the uppermost jigger 17.

The decanters 15, the jiggers 17, the protective cover 19, and the opening apparatus 16 may be made from any suitable lightweight but rigid material that is inert to the fluids to be stored. Plastics such as polypropylene provide satisfactory properties, and each item may be formed with a minimum of expense.

The decanters 15, the jiggers 17, the protective cover 19 and the opening apparatus 16 may be made from unbreakable and shatterproof material to prevent leakage or potential injury if the flexible storage container 10 is dropped during transport. Again, polypropylene or other suitable plastics are preferred. For example, the outer shape of the flexible storage container 10 may be cubic, hexahedral, or any other suitable shape. The decanters 15 and pouch 13 must be appropriately designed to accommodate and support the alternative shapes. Further by way of modification, the decanters 15 may be designed to carry varying volumes, utilizing varying widths or heights or depths. As long as the outer perimeters 21 and recessed area 26 are maintained in the desired configuration, any combination of decanter 15 shapes may be utilized.

While a single basic embodiment of the invention has been disclosed herein, it will be appreciated that modification of this particular embodiment of the invention may be resorted to without departing from the scope of the invention.

What is claimed is:

1. A multiple flask apparatus for fluid storage comprising:

at least three storage decanters, a multiplicity of measuring jiggers, and an enclosing protective cover;

each said decanter having a length having upper and lower fractions, an interior junction, and interior surfaces, said interior surfaces of the several said decanters assembled contiguously, said interior junctions of the several said decanters assembled contiguously at said lower fraction of said length, and said decanters contained within restrained by said protective cover during storage;

each said interior surface having an indented area in said upper fraction of said length, said contiguous containment and restraint of said interior surfaces forming a recessed area in said indented area wherein said multiplicity of jiggers may reside during storage;

each said jigger having a protective cap and means for vertical, releasable storage of each said jigger from other said jiggers;

each said decanter having a fluid dispensing orifice apparatus; and said protective cover having latching means and a handle apparatus.

2. A multiple flask apparatus according to claim 1, wherein said decanters are polyhedrally shaped to form a cylinder when combined by contiguously joining said interior surfaces and said interior junctions.

3. A multiple flask apparatus according to claim 2, wherein said decanters comprises three decanters.

4. A storage apparatus comprising:

a flexible container housing at least three lightweight, unbreakable storage decanters and lightweight, unbreakable measuring jiggers, said flexible container having an outer shape, carrying means for transporting said decanter and said jiggers, and enveloping means for protecting and enclosing said decanters and said jiggers;

each said lightweight, unbreakable decanter having an outer perimeter, a length, an upper surface, and two beveled interior surfaces extending inwardly from said outer perimeter to a junction, joining each said beveled interior surface on said decanter;

each said decanter further having an upper, interior, arcuate, recessed surface indented from said upper surface, extending downwardly along both said beveled interior surfaces for a fraction of said decanter length, and a plateau surface extending from said upper, interior, arcuate, recessed surface inwardly along both said beveled interior surfaces to said junction;

the combination of said decanters contiguous at said outer perimeters, said junctions, and said beveled surfaces, forming a polyhedron, said polyhedron supporting said outer surface of said flexible container;

the combination of said decanters at said upper, interior, arcuate, recessed surfaces and said plateau surfaces forming an upper, internal, cylinder area;

said jiggers having means for separable stacking and a protective cover; and, said jiggers residing in said upper, internal, cylinder area, so that during storage, the combination of said decanters restrains said jiggers and said flexible container restrains the combination of said decanters.

5. A storage apparatus according to claim 4, wherein said polyhedron and said outer shape are cylindrical.

6. A storage apparatus according to claim 4, wherein said decanters comprise three decanters.

7. A storage apparatus according to claim 4, wherein said opening means comprises a screw cap apparatus.

* * * * *